US006270190B1

(12) United States Patent
Ahn

(10) Patent No.: US 6,270,190 B1
(45) Date of Patent: Aug. 7, 2001

(54) INK-JET PRINTER HEAD AND INK SPRAYING METHOD FOR INK-JET PRINTER

(75) Inventor: Byung-Sun Ahn, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/874,128

(22) Filed: Jun. 12, 1997

(30) Foreign Application Priority Data

Jun. 12, 1996 (KR) ..... 96-21024

(51) Int. Cl.[7] ..... B41J 2/135
(52) U.S. Cl. ..... 347/44
(58) Field of Search ..... 347/44, 61, 63–65, 347/95

(56) References Cited

U.S. PATENT DOCUMENTS 4,535,343 * 8/1985 Wright et al. ..... 347/64
4,809,428 * 3/1989 Aden et al. ..... 347/63 X
5,041,844 * 8/1991 Desphpande ..... 347/65
5,194,877 * 3/1993 Lam et al. ..... 347/63
5,212,496 * 5/1993 Badesha et al. ..... 347/45
5,397,673 * 3/1995 Watson et al. ..... 347/95
5,450,109 * 9/1995 Hock ..... 347/63 X
5,805,186 * 9/1998 Yoshida et al. ..... 347/61

FOREIGN PATENT DOCUMENTS 3-203656 * 9/1991 (JP) .

* cited by examiner

*Primary Examiner*—Benjamin R. Fuller
*Assistant Examiner*—C Dickens
(74) *Attorney, Agent, or Firm*—Robert E. Bushnell, Esq.

(57) ABSTRACT

An ink-jet printer head is constructed with first electrodes formed on a silicon substrate on which oxidization is performed, and each having a region contacting ink to generate ink bubbles, and a region coated with insulating layers; second electrodes formed on a layer different from the first electrodes' layer, electrically isolated from the first electrodes by the insulating layers, and contacting the ink, and producing ink bubbles in the ink on receipt of electric energy; bubble chamber barriers for electrically isolating the first electrodes from the second electrodes and for constituting bubble chambers in the ink; a nozzle plate having a plurality of orifices through which the ink is sprayed on a print media; ink chamber barriers formed between the second electrodes and the nozzle plate, and leading the ink into the orifices by a steam pressure generated from the bubble chamber barriers; and ink chambers formed by the ink chamber barriers and the bubble chamber barriers, and each temporarily storing the ink introduced through ink channels.

19 Claims, 7 Drawing Sheets

INK-JET PRINTER HEAD AND INK SPRAYING METHOD FOR INK-JET PRINTER

CROSS REFERENCE TO RELATED APPLICATION

This application makes reference to, incorporates the same herein, and claims all benefits accruing under 35 U.S.C. §119 from INK-JET PRINTER HEAD AND INK SPRAYING METHOD FOR INK-JET PRINTER earlier filed in the Korean Industrial Property Office on the $12^{th}$ day of Jun. 1996, and there duly assigned Ser. No. 1996/21024.

BACKGROUND OF THE INVENTION

1. Field of the Invention

The present invention relates to ink-jet printers generally and, more particularly, to processes and apparatus for spraying ink from the chamber for the head of an ink jet printer and onto a printable medium.

2. Discussion of Related Art

Typically, conventional ink-jet printers include a central processing unit that is driven by signals received from a host computer through printer interface, to read a system program from memory, to store values initially set for the printing operation and various information necessary for the printing system, and to then execute the system program to produce a control signal; a read only memory that holds programs for controlling the printer; and a random access memory that temporarily stores data for operation of the system. An application-specification integrated circuit transmits data from the central processing unit to most of the peripheral logic ASICs as may be necessary to execute the instructions from the central processing unit, a head driver 30 that controls the operation of ink cartridge in response to an output control signal from the central processing unit, a maintenance motor driving circuit that serves to drive a maintenance motor and prevent the nozzle of ink cartridge from being exposed to air, a carriage motor driving circuit that controls the operation of a carriage return driving motor, and a line feed motor driving circuit which controls the operation of a line feed motor to feed paper to a top output tray by using a stepping motor. A print signal, transmitted to the print interface from the host computer, actuates these motors in response to control signals from the central processing unit during performance of the printing operation. The ink cartridge sprays small drops of ink on paper through a plurality of orifices in a nozzle to form characters on the paper in a dot-matrix format.

The ink cartridge includes ink absorbed by a sponge held in a case, and an ink-jet printer head constructed with a filter to remove impurities from the ink, an ink stand pipe chamber storing ink that is filtered by the filter, an ink via hole supplying a chip containing ink heating portions and ink chambers, with the ink delivered through a stand pipe chamber, and a nozzle plate having a plurality of orifices for expelling the ink, transmitted from ink via hole. The ink via provides ink to the ink chambers between the nozzle plate and chip, a plurality of ink channels transmit the ink to each orifice of the nozzle plate from the ink via hole, ink chambers that spray the ink supplied from ink channels, and a plurality of electrical connectors that furnish electrical power to the ink chambers.

The ink-jet printer head includes a resistor layer that is formed over a silicon oxide film created on a silicon substrate, for heating the ink with the electric energy. Two electrode layers are formed over resistor layer. Multi-layer protective layers prevent heating portions created between the two electrodes and resistor layer from being eroded and deformed by chemical interaction with the ink. The ink-jet chambers produce ink bubbles in the ink with the heat generated by the heating portions. Ink-jet printer head is typically constructed with ink channels that serve as a passage for leading the ink from ink via holes into ink chambers. Ink barriers serve as a wall to form a space used for leading the ink from the ink channels into ink chambers. A nozzle plate contains a plurality of orifices through which every ink particle, pushed according to its volume change, is sprayed onto the print media.

Nozzle plate and heating portions are spaced a predetermined distance away from each other for mutual correspondence. The pair of electrodes are connected with a bumper for electrical connection. This bumper is electrically connected with a head controller so that the ink particles can be sprayed through each orifice of the nozzle. Each ink barrier is formed to lead the ink from the side of heating portions, and is connected with common ink via to direct the ink flow out of an ink container. A head driver furnishes electric energy to a pair of electrodes in response to a control instruction of that receives a command to print through the printer interface. The power is transmitted through the two electrodes to heat heating portions by the heat of electrical resistance, i.e. joule heat ($P=I^2R$) for a predetermined period of time. The top surface of the heating portions are heated to 500° C.~550° C. to transmit the heat to multi-layer protective layers. The heat is transmitted to the ink particles spreading across the protective layers. More ink bubbles are produced by the steam pressure in the middle of the heating portions than in any other area, and the highest steam pressure is created in the middle of the heating portions. The ink bubbles, produced by this heat, cause a change in the volume of the ink on the top of the heating portions. Ink particles that are pushed as the volume of ink is changed, are jetted out through the orifices of nozzle plate.

If the electric energy, furnished to two electrodes is cut off, the heating portions cool instantaneously, and the ink bubbles are deflated and the ink returns to its original state. The ink particles, discharged to the outside, are sprayed on paper in the shape of small drops by surface tension, thus forming characters on paper in a dot-matrix format. The ink chamber's internal pressure drops according to the change in the bubble volume, and the ink from the ink container refills nozzle plate through the ink via hole.

I have noticed that the conventional ink spraying mechanism, using the conventional ink-jet printer head, has the following disadvantages. First, when forming bubbles with the super-heat so as to spray the ink onto print media, the composition of the ink may be changed by the heat, and a shock wave, created by the generation and breaking of the ink bubbles, deleteriously affects the internal components of the head, with a concomitant reduction in performance and print quality.

Second, as the ink adheres to the resistor layer and the two electrodes, the ink interacts electrically with the two electrodes, and, accordingly, corrosion occurs by ion exchange at each boundary layer of the heating portions and two electrodes, thus reducing the operational life of the head.

Third, the shock wave, created by the generation of ink bubbles in ink barrier containing the ink, causes an increase in the refresh cycle time.

Fourth, the ink drop's straight-forwardness and roundness, and the uniformity in the amount of ink discharged—all of which affect the print quality—depend on the shape of the ink drop. The manufacturing process becomes complicated, thereby increasing the production costs as the multilayer protective layers are formed over the electrodes and resistor layer.

Recent efforts to solve these problems include the formation of first and second electrodes on and under a nozzle plate, with a nozzle being formed by using an eximer laser. The nozzle is directly connected to an ink container to introduce conductive ink into the nozzle by using capillarity. High voltages are applied to the two electrodes to heat and evaporate the conductive ink inside the nozzle. The steam pressure, generated during this process, causes the ink particles inside the nozzle to be sprayed onto the print media. The upper section of the nozzle is larger than the lower section, and the voltage applied to each electrode is about 1000 Volts~3000 Volts at a frequency of up to 10 kiloHertz.

I have noticed however, that with this improved technique, as the ink inside nozzle is heated by the high voltage to be sprayed on the paper, the length of nozzle should necessarily be long. A hole in the electrode connected with the nozzle is larger than a cross-sectional area of the nozzle's lower section. Thus, when the voltage is applied to each electrode, it is difficult to achieve a concentration of electric current density that is satisfactory, thus necessarily requiring high voltages. The nozzle plate, having two electrodes and a nozzle, must be formed thick, and the time required to manufacture nozzle plate is long, thus increasing the overall production costs.

SUMMARY OF THE INVENTION

Accordingly, it is one object of the present invention to provide an ink-jet printer head that substantially obviates one or more of the problems, limitations and disadvantages of the related art. It is another object to provide an ink-jet printer head for an ink-jet printer which includes orifices through which ink is sprayed, and ink chambers temporarily containing the ink to thereby produce a steam pressure in each ink chamber, and to cause the ink in the ink chambers be sprayed onto print media through the orifices under the force of steam pressure.

It is still another object to provide an ink-jet printer head that has a nozzle that controls the size of an ink drop.

It is yet another object to provide facilitate the manufacturing process for an ink-jet printer by using a thin nozzle.

It is still yet another object to provide an ink-jet printer head constructed with a plurality of electrodes under and within its ink chambers, providing a straight flow of electric current between two electrodes, with a high current density, at a low voltage.

It is a further object to provide an ink-jet printer head enhancing the straight forwardness of the travel by ink drops and an increase in the speed of the ink spray, using a nozzle constructed with a sectional area toward paper that is smaller than the sectional area measured toward ink chambers.

It is a still further object to provide an ink-jet printer head and a process of spraying ink for an ink-jet printer, with an increased density of electric current density where a first ink bubble is created, and with consecutive production and transformation of ink bubbles around the first bubble raising the overall steam pressure.

It is a yet further object to provide an ink-jet printer head and a process for spraying ink spraying for an ink-jet printer, with an enhanced electric current density for generation of ink bubbles, by forming two electrodes on different layers for electrical insulation.

It is a still yet further object to provide an ink-jet printer head and a process for spraying ink spraying for an ink-jet printer, able to realize a straight forward emission of ink particles at a substantially constant jet velocity by maintaining steam pressure at a predetermined magnitude.

These and other advantages may be achieved in accordance with the practice of the present invention as embodied and broadly herein described, with an ink-jet printer head having ink chambers temporarily holding an ink, electrodes that are electrically isolated from each other within the ink chambers furnishing electric energy to the ink inside the ink chambers, a nozzle plate for generating ink bubbles under steam pressure created by the electric energy furnished by the electrodes, and spraying the ink onto print media.

The present invention uses a conductive ink, and the conductive ink has a predetermined resistivity value. The nozzle plate controls the size of an ink drop only, and includes a plurality of orifices each having a sectional area toward the print media smaller than the other sectional area toward the ink chamber.

The present invention also provides a process for spraying ink in an ink-jet printer by forming two electrodes within barriers forming ink chambers, applying voltages to the two electrodes, and producing ink bubbles with a high current density so that the ink is emitted as a jet under steam pressure, through a vertically positioned nozzle.

According to another aspect of the present invention, a process for spraying ink in an ink-jet printer contemplates forming a plurality of first and second electrodes on different layers, using bubble barriers as border lines, applying power to the first and second electrodes to form images and characters upon print media, and producing ink bubbles by using heat energy produced by an internal electric current and the resistivity of an electrically conductive ink, positioned between the two electrodes, to spraying the ink bubbles through orifices in a nozzle plate.

It is to be understood that both the foregoing general description and the following detailed description are exemplary and explanatory, and are intended to provide further explanation of the invention as claimed.

BRIEF DESCRIPTION OF THE ATTACHED DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

Figure 9:
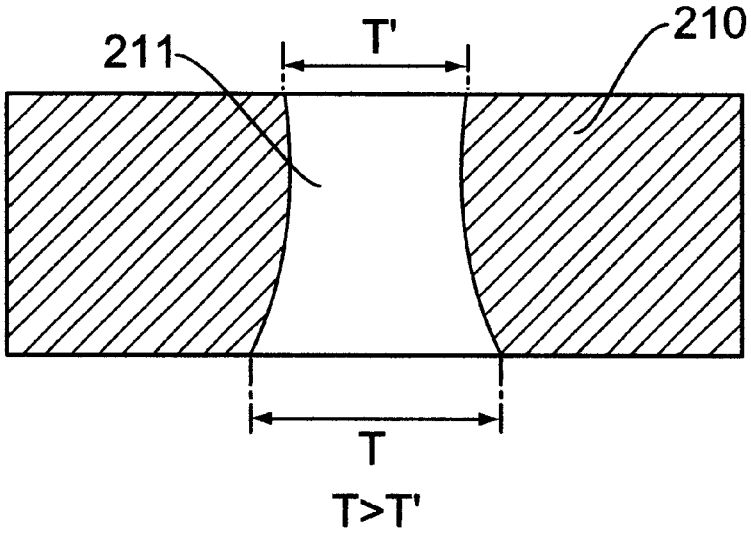
Figure 10:
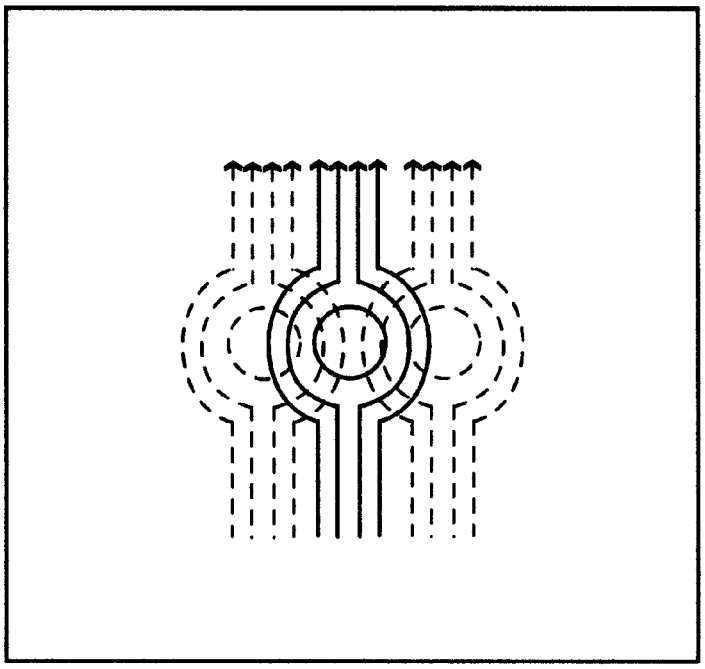

FIG. 9 schematically depicts a nozzle plate of the ink-jet printer head constructed in accordance with the principles of the present invention; and FIG. 10 is an ink spraying mechanism constructed in accordance with the principles of the present invention.

DETAILED DESCRIPTION OF PREFERRED EMBODIMENT

Figure 1:
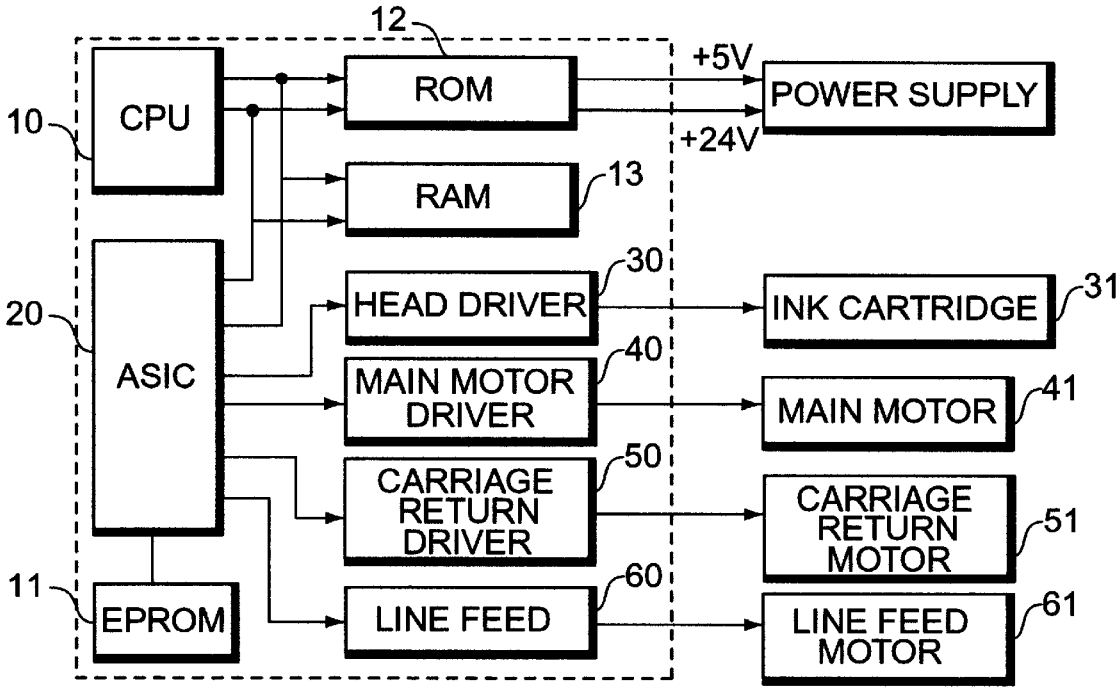
FIG. 1 is a block diagram illustrating an electronic circuit for controlling operation of an ink-jet printer.

Turning now to the drawings, the construction and operation of an electronic circuit for controlling operation of an ink-jet printer is illustrated by FIG. 1. Central processing unit (CPU) 10 that receives signals from a host computer (not illustrated) through a printer interface (also not illustrated), and reads a system program out of an erasable and programmable read only memory (EPROM) 11 that stores values initially set for the printing operation and various items of information necessary for operation of the printing system, and then executes the program in order to produce a control signal in accordance with the program. Read only memory (ROM) 12 holds programs for controlling the printer, and random access memory (RAM) 13 temporarily stores data used during operation of the system.

The control circuit has an application-specification integrated circuit (ASIC) 20 that transmits data from CPU 10 to most of the peripheral logic ASICs necessary for the operation of the system. Head driver 30 controls the operation of ink cartridge 31 in response to an output control signal from CPU 10 transmitted through ASIC 20. A main motor driving circuit 40 serves to drive a main motor 41 and prevent the nozzle of ink cartridge 31 from being exposed to air. Carriage motor driving circuit 50 controls the operation of a carriage return driving motor 51, and a line feed motor driving circuit 60 controls the operation of a line feed motor 61 for feeding paper and for discharging paper bearing printed images onto a top output tray by using a stepping motor. A print signal from the host computer, transmitted to CPU 10 by way of the print interface, actuates motors 40, 50 and 60, thereby enabling performance of the printing operation. Ink cartridge 31 sprays small drops of ink onto a print medium such as a cut sheet of paper, through a plurality of orifices formed in a nozzle of ink cartridge 31 to create images and characters on the paper in a dot-matrix format.

Figure 2:
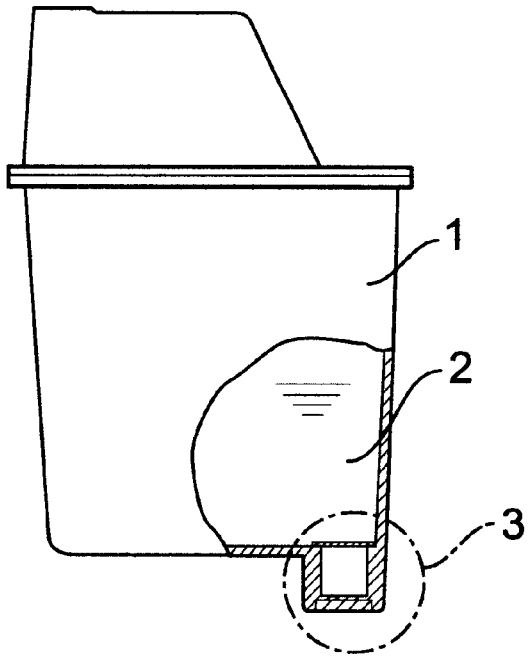
FIG. 2 is a sectional view of an ink cartridge of an ink-jet cartridge for an ink-jet printer.

Ink cartridge 31 is now described in more detail with reference to FIGS. 2 and 3, a cross-sectional view and an enlarged view, respectively of ink cartridge 31 and ink-jet printer head 3 of ink cartridge 31. Ink cartridge 31 includes a quantity of an ink 2 absorbed by a sponge held in a case 1, and an ink-jet printer head 3. Ink-jet printer head 3 has a filter 32 which removes impurities from the ink, an ink stand pipe chamber 33 storing ink strained by filter 32, and an ink via 34 that supplies the ink to a chip 35. Chip 35 is constructed with ink heating portions and ink chambers, to receive the ink delivered through ink stand pipe chamber 33, and a nozzle plate 36 perforated by a plurality of orifices for expelling the ink transmitted from ink via 34 onto print media.

Figure 3:
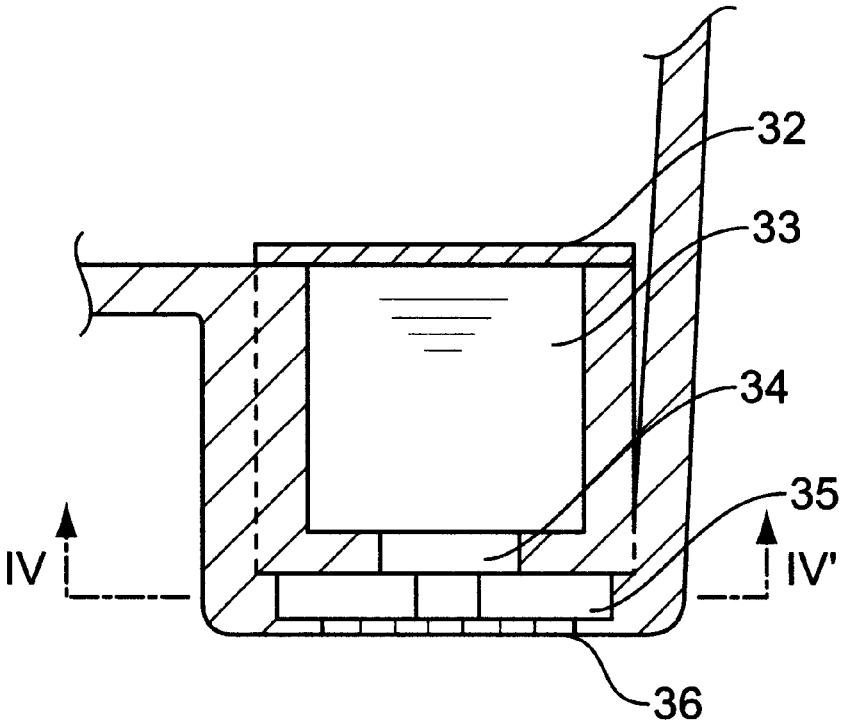
FIG. 3 is an enlarged view of the ink-jet printer head shown in FIG. 2.
Figure 4:
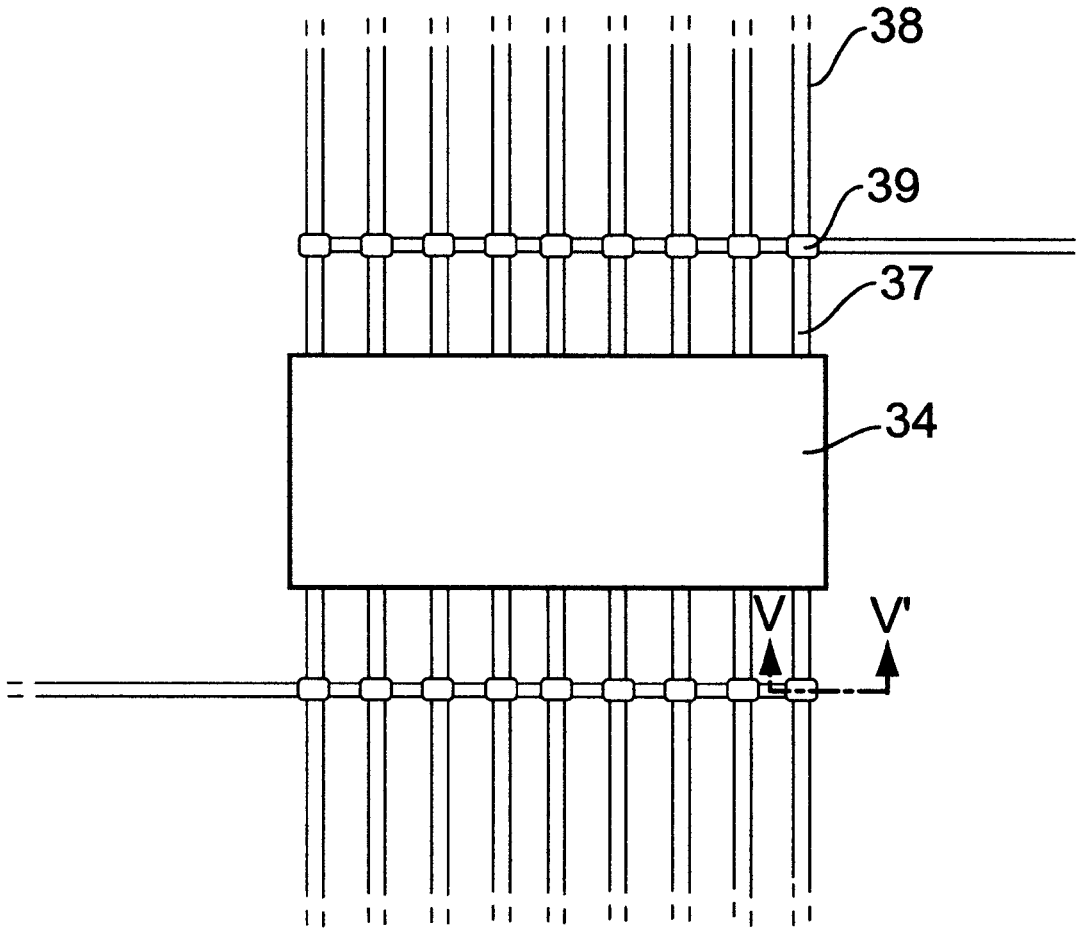
FIG. 4 is a sectional view as taken along sectional line IV–IV' of FIG. 3.

FIG. 4 is a cross-sectional view as taken along line IV–IV' of FIG. 3, that depicts ink via hole 34 for providing the ink to the ink chambers positioned between nozzle plate 36 and chip 35. A plurality of ink channels 37 transmit the ink to each orifice of nozzle plate 36 from ink via hole 34. Ink chambers 39 spray the ink supplied from ink channels 37, and a plurality of discrete and electrically separate electrical connectors 38 that furnish power to ink chambers 39.

Figure 5:
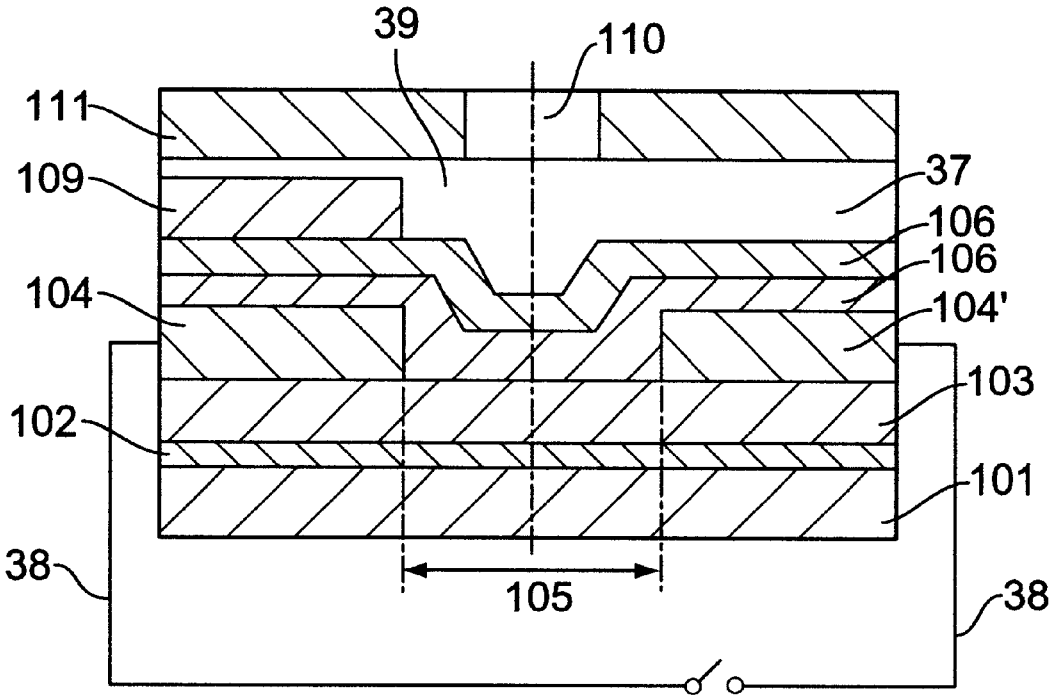
FIG. 5 is an enlarged-sectional view as taken along sectional line V–V' of FIG. 4.

FIG. 5 is an enlarged-sectional view of an ink chamber 39 as taken along line V–V' of FIG. 4, showing resistor layer 103 that is formed over silicon oxide film $SiO_2$ 102, created on a silicon substrate 101, that heats the ink with the electric energy. Two electrode layers 104 and 104' are formed over resistor layer 103 to provide electrical connection with connectors 38. Multi-layer protective layers 106 prevent heating portion 105, created between the two electrodes 104 and 104' and resistor 103, from being eroded and deformed by chemical interaction with the ink. Ink chamber 39 produces ink bubbles in the ink with the heat generated by heating portion 105.

Ink-jet printer head 3 also includes ink channels 37 that serve as a passage for leading the ink from ink via hole 34 into ink chambers 39. Ink barriers 109 serve as a wall to form a space used for leading the ink from ink channels 37 into ink chambers 39. Nozzle plate 111 is perforated by a plurality of orifices 110 through which every ink particle is pushed according to its volume change, as a spray deposited onto print media. Nozzle plate 11 and heating portions 105, shown as coaxially and symmetrically aligned, are spaced apart by a predetermined distance from each other for mutual correspondence. Pair of electrodes 104 and 104' are electrically connected through a contact array referred to as a bumper, via leads 38 for electrical connection from the outside. This bumper is electrically connected with head driver 30 so that the ink particles are sprayed through each orifice 110 of nozzle plate 111. Each ink barrier 109 is formed to lead the ink from the side of heating portions 105, and is connected with common ink via hole 34 to direct the ink flow out of an ink cartridge.

Figure 6:
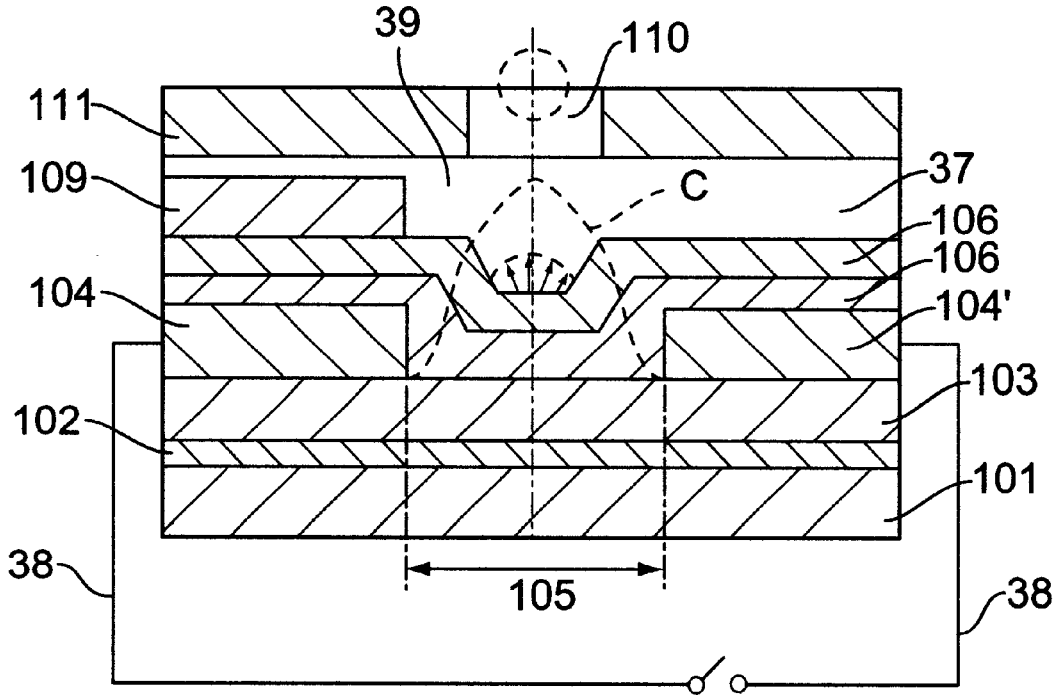
FIG. 6 shows the ink spraying mechanism constructed in accordance with the conventional art.

The ink spraying mechanism of the conventional ink-jet printer head is now described referring to FIG. 6. Head driver 30 furnishes electric energy to a pair of electrodes 104 and 104' in response to a control instruction of CPU 10 that receives a command to print through the printer interface. The power is transmitted through two electrodes 104 and 104' to heat heating portions 105 by the heat of electrical resistance, i.e., joule heat ($P=I^2R$) for a predetermined period of time. The top surface of heating portions 105 is heated to a temperature within the range of 500° C.~550° C. in order to transmit the heat to multi-layer protective layers 106. At this point, the heat is transmitted to the ink particles spreading across the protective layers 106. More ink bubbles are produced by the steam pressure within the middle C of heating portions 105 than in any other area, and the highest steam pressure is created in the middle of heating portions 105. The ink bubbles produced by this heat cause a change in the volume of ink at the top of heating portions 105. Ink particles that are pushed as the volume of ink is changed, are forced as a jet of ink out through orifices 110 of nozzle plate 111. When electrical energy furnished to electrodes 104 and 104' is interrupted, heating portions 105 cool instantaneously, and the ink bubbles deflate and collapse, whereby ink within chamber 39 returns to its original state. The ink particles, discharged to the outside of orifice 110, are sprayed onto paper while in the shape of small drops by surface tension, thus forming characters on paper in a dot-matrix format. Internal pressure of ink chamber 107 drops according to the change in the volume of the bubbles, and the ink from the ink container refills nozzle plate 111 through ink via 34.

Figure 7:
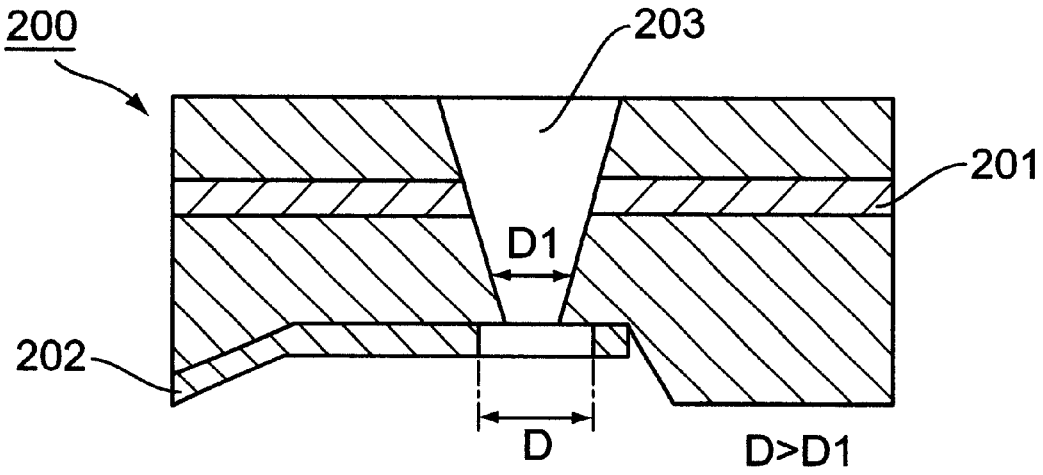
FIG. 7 depicts a nozzle plate of an ink-jet printer head constructed in accordance with an improvement in conventional art.

FIG. 7 shows an improved ink-jet printer head created to solve problems found in the performance of the printer head illustrated by FIGS. 5 and 6. First electrodes 201 and second electrodes 202 are respectively formed on and under a nozzle plate 200, and a nozzle 203 is formed by an eximer laser. Nozzle 203 is directly connected with an ink cartridge (not separately illustrated) to introduce electrically conductive ink into nozzle 203 by using capillarity. High voltages are applied to the pair of electrodes 201 and 202 in order to heat and evaporate the conductive ink in nozzle 203. The steam pressure, generated during this process, causes the ink particles in nozzle 203 to be sprayed onto print media such as cut sheets of paper. The upper section of nozzle 203 is larger than the lower section, and the voltage applied to each electrode is about 1000 Volts~3000 Volts at a frequency of up to 10 kiloHertz. As the ink in nozzle 203 is heated by the high voltage to be sprayed on the paper, the length of nozzle 203 is necessarily long. The cross-sectional dimension (e.g., the cross-sectional area) D of the orifice performating second electrode 202 connected with nozzle 203, is larger than the cross-sectional area D1 of the lower section of nozzle 203. Thus, when the voltage is applied to each electrode 201, 202, it is difficult to obtain the concentration of electric current density necessary, thus requiring application of high voltages across electrodes 201, 202. Nozzle plate 200, having two electrodes 201 and 202 and nozzle 203, is formed to be thick. Consequently, the time required to manufacture nozzle plate 200 is long, a factor that increases the overall production cost of an ink jet printer.

Figure 8:
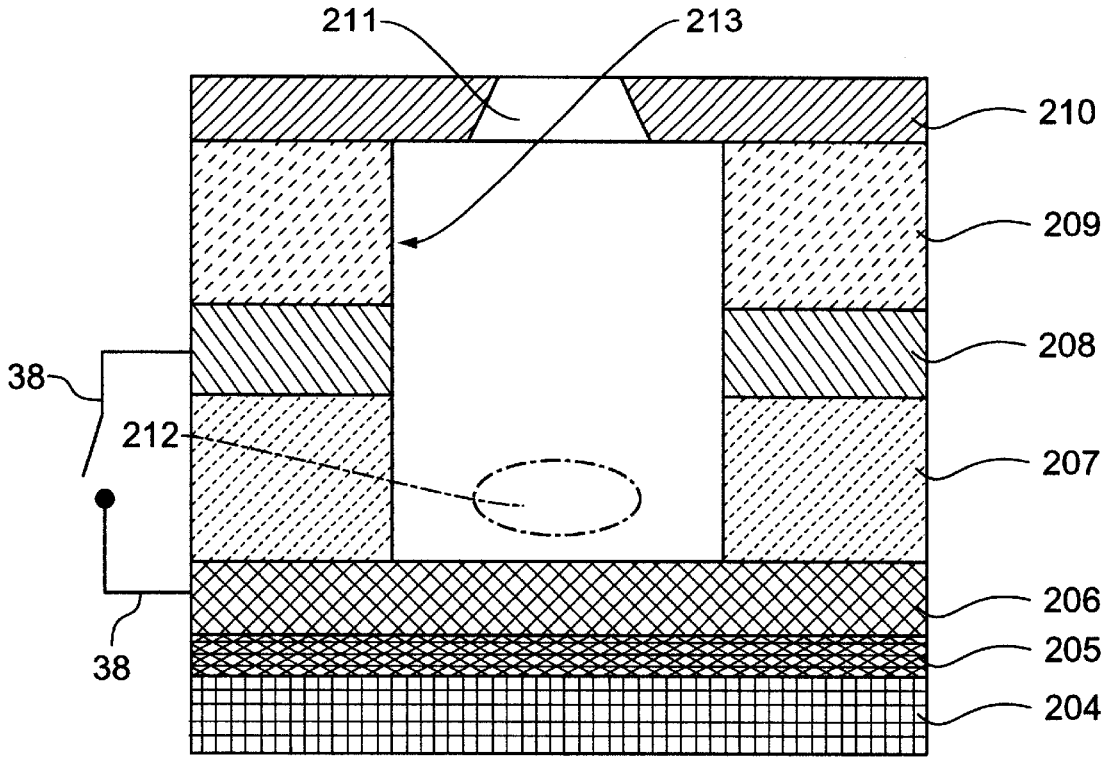
FIG. 8 is an enlarged sectional view of an ink-jet printer head constructed in accordance with the principles of the present invention.

Reference will now be made in detail to the preferred embodiments of the present invention, examples of which are illustrated in the accompanying drawings. FIG. 8 is an enlarged sectional view of an ink-jet printer head constructed in accordance with the principles of the present invention. The ink-jet printer head includes a silicon substrate 204. A $SiO_2$ layer 205 is formed on silicon substrate 204 by oxidization. First electrodes 206 each have a region where bubbles are created in ink while the electrode is wetted with the ink, and adjacent regions coated with insulating layers. Second electrodes 208 are each formed on a layer different from the layer of first electrodes 206, and are electrically isolated from first electrodes 206 by the insulating layers, are wetted with the ink, and produce bubbles in the ink on receipt of electric energy. Bubble chamber barriers 207 are used to electrically isolate first and second electrodes 206 and 208 from one another and to form bubble chambers for the ink.

The ink-jet printer head also includes a nozzle plate 210 forming one wall of the chamber. Nozzle plate 210 is perforated by a plurality of tapered (e.g., conical, or alternatively, hyperbolically curved) orifices 211 through which the ink is sprayed onto print media. Ink chamber barriers 209 are formed between second electrodes 208 and nozzle plate 210, to direct the ink into orifices 211 under the pressure of steam generated from bubble chamber barriers 207. Ink chamber 213 is formed by ink chamber barriers 209 and bubble chamber barriers 207, to temporarily store the ink introduced into chamber 213 through an ink channel (not illustrated).

First and second electrodes 206 and 208 are formed of an alloy of nickel and platinum so as to prevent corrosion due to the ion exchange with the conductive ink. Nozzle plate 210 perforated by orifices 211, correspond to first and second electrodes 206 and 208 wetted by the ink, is supported by ink chamber barriers 209. Nozzle plate 210 controls the formation and size of each of the ink drops sprayed through orifice 211, and is formed to a thickness of within the range of approximately 30 $\mu$m to 40 $\mu$m, thus facilitating the manufacturing process.

As shown in FIG. 9, a greatest cross-sectional area T of each of orifice 211 formed in the entrance of nozzle plate 210, is larger than a sectional area T' formed in the exit side of nozzle palte 210, to enhance the straight-forwardness of the ink drops emitted. The printing mechanism of an ink-jet printer disclosed in the present invention is somewhat similar to that of the conventional ink-jet jet printer, and the following description relates to only the ink-jet printer head of the present invention. In order to form characters on a predetermined area of a print media, a head driver 30 applies electric energy, in the form of an electrical signal, to the corresponding electrode. Voltage is applied to first electrodes 206, i.e., individual electrodes through an electrical connector, and, simultaneously with this, voltage of the opposite polarity is applied to second electrodes 208 as common electrodes. In one embodiment, a direct current voltage with the range of approximately 0V~100V is applied across the respective electrodes 206 and 208, and a direct current of 0 A~5 A flows across electrodes 206 and 208. The electricity flows through the conductive ink with a predetermined resistivity value, while the individual and common electrodes are wetted by the ink.

The ink, which contains sodium chloride NaCl, has electrical conductivity, and emits heat by the internal current and resistivity. The electric energy is converted into heat energy according to Joule's law, as P equals ($I^2 \cdot R$), (where P is power; I is electrical current; and R is electrical resistance). As shown in FIG. 10, when a first ink bubble is produced in bubble chambers 212, the current density flows around the first bubble, and does not pass through the bubble. As the current density is increased around the bubble to make the current high, heat is generated by the increase of power so that ink bubbles are consecutively produced around the first bubble. In other words, once the first ink bubble is produced, as the current density increases around the first bubble, bubbles are produced successively, and some big bubbles are formed by connection and transformation (i.e., by merger) of the bubbles, thereby increasing the steam pressure.

There is a continuous consecutive generation of bubbles within bubble chambers 212 by the electric energy applied to the electrodes for a predetermined period of time. This causes production of a high steam pressure and a concomitant change in the volume of the bubbles. The ink contained within ink chambers 213 is pushed out through orifices 211 of nozzle plate 210. The ink pushed out of orifices 211 is gradually formed into the shape of small drops in the nozzle created by orifices 211, and if the electric energy, applied to first electrodes 206, is cut off, bubbles in bubble chambers 212 cease to be produced. At the same time, the ink drops of the nozzle that are about to be sprayed are separated from each other due to the internal voltage drop, and then forces out as a jet of ink onto a print medium. The ink held in the ink storage vessel (e.g., an ink cartridge) refills ink chambers 213 through the ink via hole and ink channel. Characters are formed on the print media by repeating the ink spray and ink refill.

While the conventional head structure includes heating portions that each consist of electrodes and resistor for heating the ink, according to the practice of the present invention for generating bubbles, first and second electrodes are formed on different layers to serve as individual and common electrodes, respectively, and voltages, different from one another in their polarity, are applied across these electrodes. Ink bubbles are produced by the heat that is generated by the ink's internal current and resistivity, using the current flow due to the difference of the current density. Thus, the present invention does not require protective layers that prevent damage to the head's internal electrodes, and precludes damage to the head's outer surface by the heat produced from the conventional heating portions.

According to the conventional art, ink bubbles are produced and burst right upon the outer surface of each of the resistor and heating portions, and these outer surfaces may be damaged by a shock wave, created by the generation or breaking of the ink bubbles, thus reducing the head life. Embodiments of the present invention do not suffer from such a disadvantage. Moreover, print heads constructed as embodiments of the present invention have a simple internal structure, which lowers the production costs. The formation of two electrodes on different layers assures the straightforwardness of the current density between two electrodes and the increase of the current density. Since the distance between the two electrodes is short, it is easy to drive the electrodes at a comparatively lower voltage, and each of the orifices has a smaller cross-sectional area facing toward the print media than the cross-sectional area existing coextensively with the inner walls of the ink chamber, thereby enhancing the straight-forwardness of the ink drops. In the present invention the first and second electrodes serve as individual and common electrodes, respectively, and vice versa.

The foregoing paragraphs describe the details of apparatus and processes for spraying ink from the ink chamber of the head in an ink-jet printer by applying voltages to first and second electrodes, each formed in the printer's ink chambers on different layers, in order to generate bubbles of conductive ink by joule heat, thus spraying ink particles through a nozzle by using steam pressure. It will be apparent to those skilled in the art that various modifications and variations can be made in the ink-jet printer head and ink spraying method for an ink-jet printer of the present invention without departing from the spirit or scope of the invention. Thus, it is intended that the present invention cover the modifications and variations of this invention provided they come within the scope of the appended claims and their equivalents.

What is claimed is:

1. An ink-jet printer head, comprising:

a substrate;

a first electrode formed on the substrate, a region of said first electrode defining the bottom of an ink chamber;

a bubble chamber barrier formed on said first electrode, a side of said bubble chamber barrier defining a lower portion of a wall of the ink chamber, said bubble chamber barrier for providing electrical insulation;

a second electrode formed on said bubble chamber barrier, a side of said second electrode defining a middle portion of a wall of the ink chamber;

an ink chamber barrier layer formed on said second electrode layer, a side of said ink chamber barrier layer defining an upper portion of a wall of the ink chamber; and a nozzle plate formed on said ink chamber barrier layer, said nozzle plate defining a top portion of the ink chamber and having an orifice for spraying ink from the ink chamber to the exterior of the printer head.

2. The ink jet printer head of claim 1, said ink chamber barrier layer having an ink channel for providing ink to the ink chamber.

3. The ink jet printer head of claim 2, further comprising:

an ink via hole connected to the ink channel, for providing ink to the ink channel.

4. The ink jet printer head of claim 1, further comprising:

conductive ink in the ink chamber.

5. The ink jet printer head of claim 4, said conductive ink comprising NaCl.

6. The ink jet printer head of claim 1, said first electrode being made of a nickel platinum alloy.

7. The ink jet printer head of claim 1, said second electrode being made of a nickel platinum alloy.

8. The ink jet printer head of claim 1, the wall of the ink chamber as defined by the bubble chamber barrier, second electrode and ink chamber barrier being linear in cross-section.

9. The ink jet printer head of claim 1, said orifice having tapered walls.

10. The ink jet printer head of claim 9, said orifice being conical in shape.

11. The ink jet printer head of claim 10, the cross section of the orifice on the ink chamber side of the nozzle plate being larger than the cross section of the orifice on the exit side of the nozzle plate.

12. The ink jet printer head of claim 9, said orifice having hyperbolically curved walls.

13. The ink jet printer head of claim 12, the cross section of the orifice on the ink chamber side of the nozzle plate being larger than the cross section of the orifice on the exit side of the nozzle plate.

14. The ink jet printer head of claim 12, said nozzle plate having a thickness of 30 to 40 $\mu$m.

15. The ink jet printer head of claim 9, the cross section of the orifice on the ink chamber side of the nozzle plate being larger than the cross section of the orifice on the exterior side of the nozzle plate.

16. The ink jet printer of claim 1, further comprising a $SiO_2$ layer located between said substrate and said first electrode.

17. A method of ink-jet printing, comprising the steps of:

filling conductive ink in an ink chamber of an ink jet printer head;

applying a voltage between a first electrode formed at the bottom of the ink chamber and a second electrode formed on the wall of the ink chamber and separated from the first electrode by an insulating barrier, to form an ink bubble in a bubble chamber region of the ink chamber above the first electrode.

18. The method of claim 17, said step of applying a voltage further comprising applying a direct current voltage in the range of approximately 0 volts to 100 volts.

19. The method of claim 17, said step of applying a voltage further comprising drawing a current in the range of approximately 0 Amperes to 5 Amperes.

* * * * *